US006932146B2

(12) United States Patent
Nichol et al.

(10) Patent No.: US 6,932,146 B2
(45) Date of Patent: Aug. 23, 2005

(54) METHOD AND APPARATUS FOR LOW PRESSURE ALUMINUM FOAM CASTING

(75) Inventors: Scott Nichol, Toronto (CA); James K. Killingbeck, Barrie (CA); Richard G. Manely, Brampton (CA)

(73) Assignee: Cymat Corp., Mississauga (CA)

( * ) Notice: Subject to any disclaimer, the term of this patent is extended or adjusted under 35 U.S.C. 154(b) by 0 days.

(21) Appl. No.: 10/863,384

(22) Filed: Jun. 9, 2004

(65) Prior Publication Data

US 2004/0216855 A1 Nov. 4, 2004

Related U.S. Application Data

(62) Division of application No. 10/222,407, filed on Aug. 19, 2002, now Pat. No. 6,840,301.
(60) Provisional application No. 60/312,757, filed on Aug. 17, 2001.

(51) Int. Cl.[7] ..... B22D 18/04; B22D 27/00
(52) U.S. Cl. ..... 164/306; 164/79
(58) Field of Search ..... 164/79, 113, 119, 164/306

(56) References Cited

U.S. PATENT DOCUMENTS 3,214,265 A 10/1965 Fiedler
3,297,431 A 1/1967 Ridgway, Jr.
3,940,262 A 2/1976 Niebylski et al.
4,618,427 A 10/1986 VenÃs

FOREIGN PATENT DOCUMENTS

JP 55-84260 * 6/1980

OTHER PUBLICATIONS

G. Davies et al., "Review Metallic Foams: Their Prdoduction, Properties and Applications," Journal of Material Science, 1983, pp. 1899–1911, No. 18.

* cited by examiner

*Primary Examiner*—Kuang Y. Lin
(74) *Attorney, Agent, or Firm*—Cahn & Samuels, LLP.

(57) ABSTRACT

A method for casting an article composed of a foamed metal includes positioning a die with a die cavity above a bath of a molten metal and pressurizing the bath to cause the molten metal to fill the die cavity. A gas is then bubbled through the molten metal to form a foam. The foam is formed in the die cavity. Once the foam in the die cavity is solidified, the pressure in the bath is released and the formed article is removed. An apparatus for the method includes a die positioned above the bath, the die having a die cavity in fluid communication with the bath. The bath is provided with a pressurizing means and a venting means as well as a gas supply port for forming the foam.

18 Claims, 3 Drawing Sheets

METHOD AND APPARATUS FOR LOW PRESSURE ALUMINUM FOAM CASTING

This application is a divisional of U.S. patent application Ser. No. 10/222,407, filed Aug. 19, 2002, now U.S. Pat. No. 6,840,301, which claims the benefit of U.S. Provisional Patent Application Ser. No. 60/312,757, filed Aug. 17, 2001.

I. BACKGROUND OF THE INVENTION

The present invention relates to a method and apparatus for casting articles from metal foam. More specifically, the invention provides a method of casting articles using a low pressure method of introducing metal foam into a die cavity.

Low pressure casting processes are commonly known in the art. Generally, these processes involve an apparatus including a die and a bath containing a molten metal, such as aluminum. The die and bath are fluidly connected with a riser tube. In the known method, the molten metal is forced upwardly through the riser tube, the tube having its lower end extending below the level of molten metal in the bath and having its upper end connected to an aperture in the die cavity. The molten metal is raised by applying gaseous pressure to the molten metal in the bath. The molten metal then rises up the riser tube and into the die cavity, where the metal solidifies. The gaseous pressure is then reduced allowing excess molten metal to fall back down the riser tube and into the bath. The casting is then allowed to cool further, after which the die cavity is opened to remove the casting therefrom. This process results in a solid article made of the metal. Examples of such low pressure casting are provided in U.S. Pat. Nos. 4,860,820 and 4,875,518 and Japanese application publication number 58003769.

In the manufacture of products such as automobiles etc., there is a high demand for components to be made from materials that have a high strength to weight ratio. In order to meet this demand, much emphasis has been placed on finding materials that are considerably low in weight yet maintain the required structural strength. One such material that has been proposed is foamed metal, such as foamed aluminum. Various methods have been proposed for producing metal foam such as in U.S. Pat. Nos. 5,221,324 and 5,622,542. These methods generally involve the bubbling of a gas through a bath of molten metal, thereby creating a metal foam above the bath. The foam is then drawn off the bath and cooled to form a slab. The slab is then cut or worked to form a desired article. The molten metal normally includes additives such as a metal matrix composite (MMC) and preferably other components such as refractory particles and stabilizers etc. to ensure that the foam generated by the process is preserved. That is, the additives are provided to facilitate the stabilization of the cells comprising the foam.

A need exists for a method of forming a metal foam article using a casting type process.

II. SUMMARY OF THE INVENTION

In one embodiment, the present invention provides a method of casting an article from a molten metal comprising: a) providing a bath containing said molten metal; b) providing a die having a die cavity in fluid communication with said bath, the die being located above said bath; c) establishing a pressure within said bath, said pressure being sufficient to cause flow of said molten metal into said die cavity; d) bubbling a gas through said molten metal to form a foam of said molten metal; e) causing said foam to enter and fill said die cavity; f) releasing the pressure in said bath; g) removing said formed article from said die cavity.

In another embodiment, the invention provides an apparatus for casting an article from a foamed molten metal comprising: a bath for containing said molten metal; a heat source for said bath for maintaining the metal in a molten state; a pressurizing means; a pressure releasing means; a gas supply means for bubbling a gas through said molten metal; a die having a die cavity complementary in shape to said article; a channel for establishing a fluid communication between said die cavity and said bath.

III. BRIEF DESCRIPTION OF THE DRAWINGS

IV. DETAILED DESCRIPTION OF THE PREFERRED EMBODIMENTS

Figure 1:
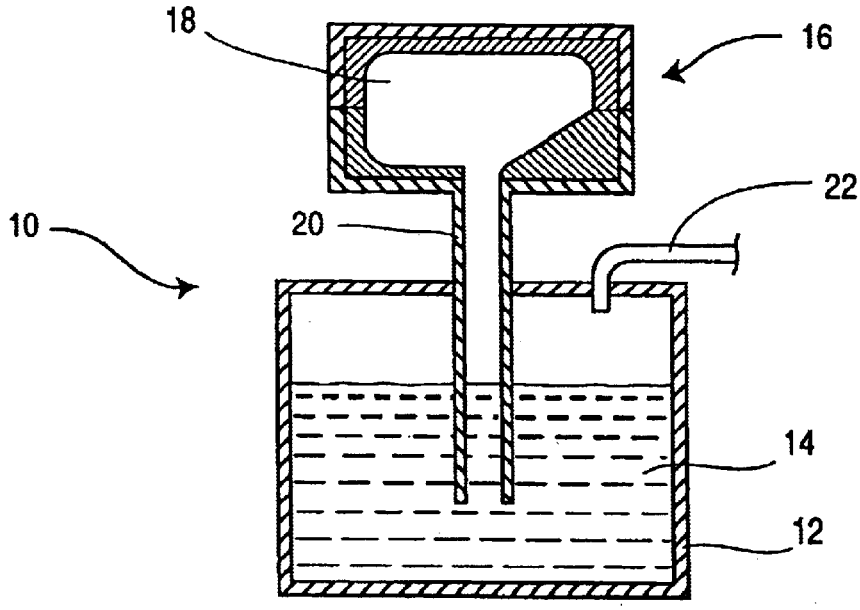
Figure 1 ( Prior Art )
FIG. 1 is a cross sectional elevation of a low pressure casting apparatus of the prior art.

As illustrated in FIG. 1, the prior art low pressure casting apparatus is generally indicated at 10. The apparatus includes a bath 12 containing a molten metal 14. The bath 12 is contained within a furnace or otherwise heated in order to maintain the metal in the molten state. The apparatus 10 also includes a die 16, including a die cavity 18. As shown, the die 16 may be comprised of two portions or may be constructed in any other known manner so that the die may be opened to remove the formed article. The die 16 and the bath 12 are fluidly connected by means of a tube 20. As can be seen, the top end of the tube 20 opens into the die cavity 18 while the bottom end of the tube 20 extends below the fluid level of the molten metal. The apparatus also includes a port 22 for pressurizing and venting the bath 12.

Although the present discussion uses the term "molten metal" throughout, it will be understood that such term includes a MMC as described above and any type of metal or metal alloy. Further, such term will also include a molten metal or alloy that includes any variety of known additives such as refractory materials, stabilizing particles etc.

In operation, the bath is pressurized by passing a gas into the bath through port 22. The pressurization causes the molten metal 14 to rise up through the tube 20 and into the die cavity 18. Once the cavity is filled, the port 22 is opened to release the pressure in the bath thereby causing any remaining molten metal in the tube to re-enter the bath. The molten metal that entered the die cavity will have cooled enough to solidify. Thereafter, the die 16 is opened and the formed article is removed.

Figure 2:
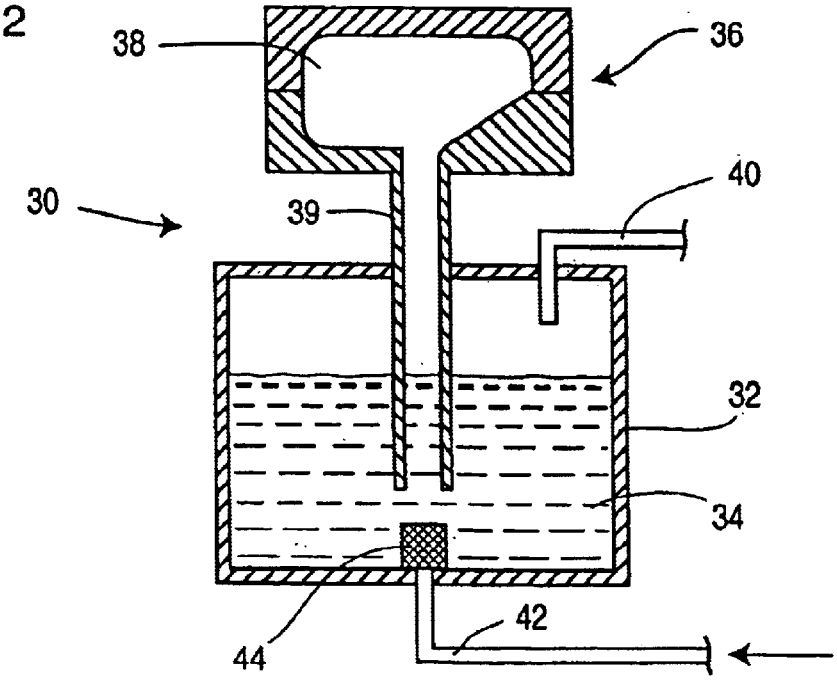
FIG. 2 is a cross sectional elevation of a low pressure casting apparatus of the present invention.

FIG. 2 illustrates a casting apparatus, generally indicated at 30, according to a preferred embodiment of the invention. As shown, the apparatus 30 includes a bath 32 containing molten metal 34. In the preferred embodiment, the metal is aluminum; however, as will be appreciated by those skilled in the art, other metals may also be used. The apparatus also includes a die 36 having a die cavity 38 that is complementary in shape to the shape of the article to be produced. The die cavity 38 is fluidly connected to the molten metal 34 via tube 39 in the same manner as described above in relation to the prior art. As with the prior art apparatus, the apparatus 30 of the present invention also includes a port 40 for pressurizing and venting the bath 32. The apparatus further includes a second gas supply port 42 connected at the bottom of the bath 32. In a preferred embodiment, the gas supply port 42 is connected to a porous plug 44 at the bottom of the bath 32. The plug 44 is designed to permit the passage of gas into the bath but does not permit passage of the molten metal therethrough. As is explained further below, the purpose of the plug 44 is to permit gas from a supply (not shown) to bubble through the molten metal to thereby cause foaming of the molten metal, as is known in the art.

As will be appreciated, the porous plug 44 can be substituted by any other known means of introducing the gas. For example, in one embodiment, the plug can be replaced with a gas discharge impeller as is known in the art.

Figure 3:
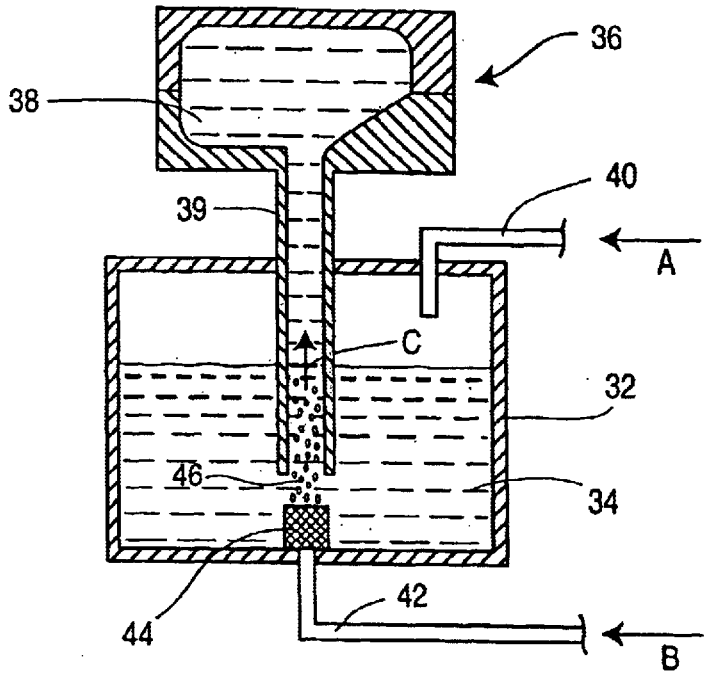
FIG. 3 is a cross sectional elevation of the apparatus of FIG. 2 during the foaming step.
Figure 5:
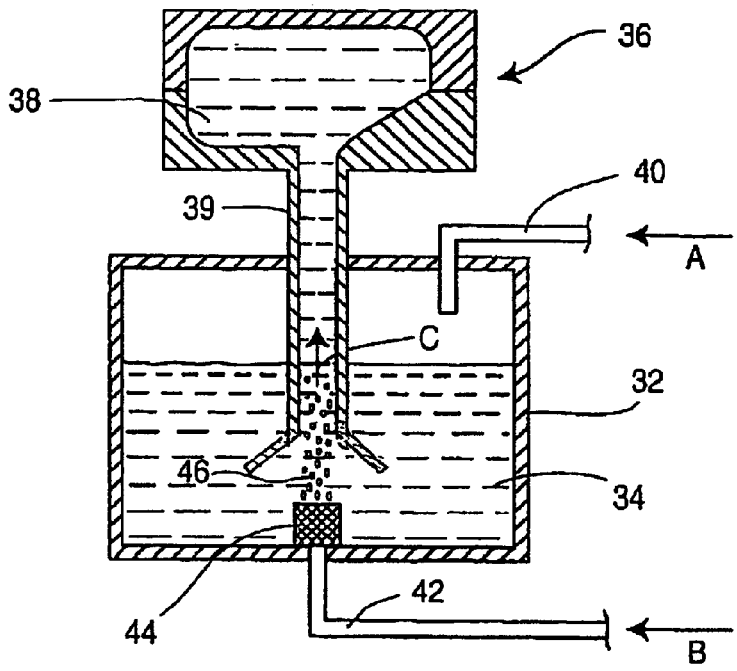
FIG. 5 is a cross sectional elevation of another embodiment of the apparatus of FIG. 3.

FIG. 3 illustrates the apparatus of FIG. 2 during the first step of the casting process. In this stage, a pressurizing gas is passed into the bath 32 through the port 40. The direction of the arrow A indicates the flow of gas into the bath 32. The pressurization of the bath causes the molten metal 34 to be forced up the tube 39 and into the die cavity 38. The pressurization is continued until the die cavity is filled with the molten metal. After the die cavity is filled in this manner, gas is supplied to the gas supply port 42 as shown by the arrow B. The gas is passed through the porous plug 44 and bubbles into the molten metal 34. Due to the pressure applied to the bath through port 40 and/or due to their natural buoyancy, the bubbles 46 preferentially rise up the tube 39 as is shown by the arrow C. Upon reaching the die cavity 38, the bubbles displace the molten metal contained therein. It will be understood by persons skilled in the art, that the gas supply port 42 should preferably be positioned in such a manner as to ensure that the bubbles 46 generated enter the tube 39 instead of the bath 32. As illustrated, one preferred means of ensuring that the bubbles 46 enter the tube 39 is to position the gas supply port 42 directly beneath the opening of the tube 39. In another embodiment as shown in FIG. 5, the terminal opening of the tube 39 may be flared or have any other similar shape that will ensure that the bubbles 46 are directed up through the tube 39.

In a preferred embodiment, once the molten metal fills the interior of the die, it is allowed to cool for a period of time prior to introducing the gas through supply port 42. Such cooling of the molten metal causes hardening of the melt adjacent the inner surface of the die cavity. In this manner, once the metal foam occupies the die cavity, the final product is provided with a relatively smooth outer surface, or skin. As will be appreciated, this embodiment is desirable in cases where such smooth outer surface characteristics are needed for either aesthetic or mechanical reasons.

Figure 4:
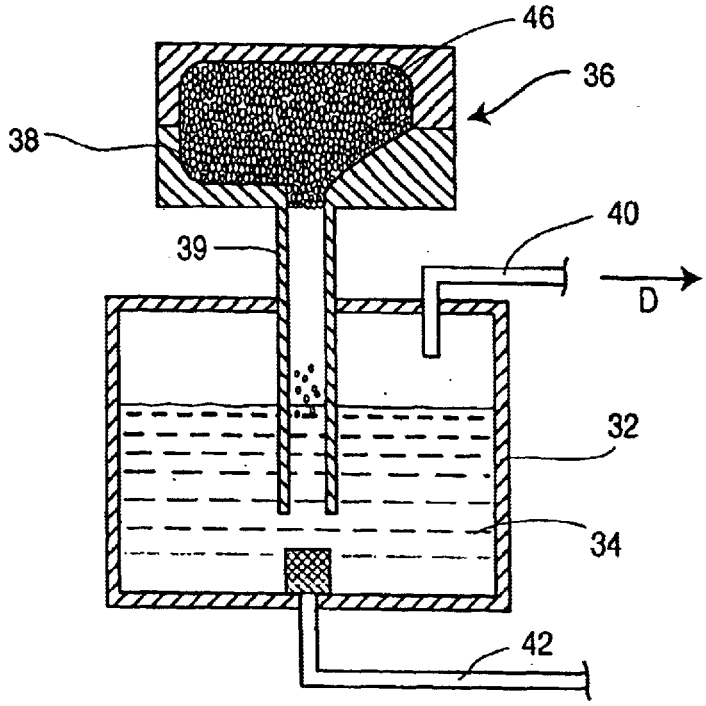
FIG. 4 is a cross sectional elevation of the apparatus of FIG. 2 after die cavity is filled with the metal foam.

FIG. 4 illustrates the second step of the casting process. As shown, the bubbles 46 have now migrated into the die cavity 38 filling same with a metal foam. The foam is then allowed to cool and solidify within the die cavity 38 and, thereby, assume the shape of such cavity. At this point, the flow of gas to the gas supply port 42 is turned off thereby stopping the generation of any further bubbles and, therefore, stopping the formation of additional metal foam. The port 40 is also opened to release the pressure within the bath 32 as indicated by the arrow D. Such a normalization of the pressure causes the level of molten metal in the tube 39 to drop to the level of the metal in the bath 32, thus generally voiding the tube 39. Subsequently, the die 36 is opened and the formed article is removed. As will be appreciated, the article formed by this process will have the same three dimensional shape as the die cavity 38. Accordingly, it will be understood that each desired article will require a respective die and die cavity.

As will also be understood, the purpose of the present invention is to fill the die cavity with a metal foam that will assume the shape thereof. Accordingly, the conditions of temperature, pressure and gas flow rate should be chosen to generate such foam. Further, as is known in the art, the molten metal can include additives for stabilizing the foam generated by the present invention, thereby ensuring that the bubbles formed in the molten metal do not collapse.

As will be understood by persons skilled in the art, when the bath 32 is pressurized, the rise of the molten metal 34 into the die cavity 38 will lead to a reduction in the volume of the molten metal in the bath 32 will decrease thereby leading to a drop in the level of the metal. To accommodate such a drop in level, the tube 39 should be long enough so that the bottom end is maintained submerged in the molten metal 34. Alternatively, the volume of the molten metal 34 should be maintained at a minimum value so as to ensure that the bottom of the tube 39 is continuously submerged therein.

The apparatus of the invention may also include various other modifications as will be apparent to persons skilled in the art. For example, various means may be employed to maintain the bath 32 at the temperature required to keep the metal in the molten state. As indicated above, the bath 32 may be located within a furnace. Alternatively, in another embodiment, the bath 32 may be provided with an internal or external heating element. The apparatus may also include a thermocouple extending into the molten metal to monitor the temperature thereof.

In another embodiment, the port 40 may include a one way valve and be used solely for the purpose of pressurizing the bath. In such case, a further port may be provided for venting the bath to normalize the pressure therein.

Although the present invention has been described in reference to various preferred embodiments, various modifications thereof will be apparent to persons skilled in the art without departing from the spirit or scope of the invention as defined herein.

The embodiment of the invention in which an exclusive right or privilege is claimed are defined as follow:

1. An apparatus for casting an article from a foamed molten metal comprising:

a bath for containing said molten metal;

a heat source for said bath for maintaining the metal in a molten state;

a pressurizing means;

a pressure releasing means;

a gas supply means for bubbling a gas through said molten metal;

a die having a die cavity complementary in shape to said article;

a channel for establishing a fluid communication between said die cavity and said bath, wherein said gas supply means comprises a source of pressurized gas, and a gas inlet in said bath, said gas inlet being provided proximal to an opening of said channel so as to divert said foam into said die cavity.

2. The apparatus of claim 1 wherein said die is positioned above said bath.

3. The apparatus of claim 1 wherein said channel comprises a generally vertically oriented tube having a first end located above said gas inlet and an opposite second end opening into said die cavity.

4. The apparatus of claim 3 wherein said first end is provided with a guide means for guiding foam into said first end.

5. The apparatus of claim 3 wherein said channel first end is immersed in the molten metal.

6. The apparatus of claim 1 wherein said pressurizing means and said pressure releasing means comprise a port on said bath for permitting entry of pressurizing gas into a space in said bath above the level of said molten metal and for permitting exit of said gas.

7. The apparatus of claim 1 further including a cooling means for cooling said die.

8. The apparatus of claim 1 wherein said bath is sealed for permitting pressurization.

9. An apparatus for casting an article from a foamed molten metal, the apparatus comprising:

a bath for containing said molten metal;

a heat source for said bath for maintaining the metal in a molten state;

a pressurizing means;

a pressure releasing means;

a gas supply means for bubbling a gas through said molten metal;

a die having a die cavity complementary in shape to said article, said die being positioned above said bath and above said gas supply means; and a channel for establishing a fluid communication between said die cavity and said bath, wherein said channel comprises a generally vertically oriented tube having a first end located above and proximal to said gas inlet, so as to divert foam into said channel, and an opposite second end opening into said die cavity and wherein said channel first end is immersed in the molten metal.

10. The apparatus of claim 9 wherein said pressure releasing means comprises a venting means for releasing pressure in said bath.

11. The apparatus of claim 9 wherein said gas supply means comprises a source of pressurized gas and a gas inlet in said bath.

12. The apparatus of claim 11 wherein said inlet comprises a porous plug for allowing passage of said gas and preventing passage of said molten metal.

13. The apparatus of claim 11 wherein said gas inlet comprises a gas discharge impeller.

14. The apparatus of claim 9 wherein said gas supply means is positioned at the base of said bath.

15. The apparatus of claim 9 wherein said channel first end is provided with a guide means to facilitate entry of said foam into said first end.

16. The apparatus of claim 9 wherein said pressurizing means and said pressure releasing means comprise a single port on said bath for permitting entry of pressurizing gas into a space in said bath above the level of said molten metal and for permitting exit of said gas.

17. The apparatus of claim 9 further including a cooling means for cooling said die.

18. The apparatus of claim 9 wherein said bath is sealed for permitting pressurization.

* * * * *